US006058720A

United States Patent [19]

Ryu

[11] Patent Number: 6,058,720

[45] Date of Patent: May 9, 2000

[54] AUTOMATIC ICE MAKING APPARATUS FOR USE IN A REFRIGERATOR

[75] Inventor: Gang Ryu, Incheon, Rep. of Korea

[73] Assignee: Daewoo Electronics Co., Ltd., Rep. of Korea

[21] Appl. No.: 09/195,804

[22] Filed: Nov. 19, 1998

[30] Foreign Application Priority Data

Dec. 13, 1997 [KR] Rep. of Korea ..... 97-68477

[51] Int. Cl.[7] ..... F25C 1/10

[52] U.S. Cl. ..... 62/135; 62/353

[58] Field of Search ..... 62/135, 353

[56] References Cited

U.S. PATENT DOCUMENTS

| | | | |
|---|---|---|---|
| 3,071,933 | 1/1963 | Shoemaker | 62/353 |
| 3,745,779 | 7/1973 | Bright | 62/135 |
| 4,142,378 | 3/1979 | Bright et al. | 62/135 |
| 4,332,146 | 6/1982 | Yamazaki et al. | 62/353 |
| 4,424,683 | 1/1984 | Manson | 62/135 |

*Primary Examiner*—William E. Tapolcai
*Attorney, Agent, or Firm*—Pennie & Edmonds LLP

[57] ABSTRACT

A reverse condition sensing mechanism incorporating in an ice making apparatus for use in a refrigerator includes a movable lever mounted on an output shaft to be rotated therewith and a fixing plate vertically mounted on a periphery surface of the output shaft. The movable lever has a shaft fixing portion fixed into the output shaft for rotating an ice tray, a rotating portion extending from the shaft fixing portion and vertically projected therefrom, and a contacting conductor mounted on a surface of the rotating portion. The fixing plate has a horizontal contact for sensing a horizontal condition of the ice tray and a reverse contact for sensing a reverse condition of the ice tray, the contacts being at intervals of a predetermined distance. The horizontal and the reverse conditions are sensed depending on the contacts being electrically contacted with the contacting conductor of the movable lever.

5 Claims, 6 Drawing Sheets

AUTOMATIC ICE MAKING APPARATUS FOR USE IN A REFRIGERATOR

FIELD OF THE INVENTION

The present invention relates to an automatic ice making apparatus for use in a refrigerator; and, more particularly, to an automatic ice making apparatus incorporating therein a reverse condition sensing mechanism capable of carrying out an overturning operation of an ice tray reliably and having a reduced number of parts or components.

DESCRIPTION OF THE PRIOR ART

One of the well known refrigerators is provided with an automatic ice making apparatus, wherein water supplied by a water supplying device to an ice tray rotatably installed is frozen to form ice cubes. The ice cubes are then separated from the ice tray and deposited into a subjacent restore bin.

There is shown in FIG. 1 a refrigerator provided with an ice making apparatus. As shown, such a refrigerator 1 is divided into a freezing chamber 2, a refrigerating chamber 4, and an ice making chamber 6 between the chambers. The ice making apparatus includes an ice maker 10 installed in the ice making chamber 6 and a water supplying device 20 installed in the refrigerating chamber 4.

In FIG. 2, the ice maker employed in the ice making apparatus in FIG. 1 is shown in detail. The ice maker 10 includes a housing 11 incorporating a motor 12 and a printed circuit board 13 for operating the motor 12, and a gear mechanism 14 for increasing and reducing a driving force of the motor 12, an output shaft 15 for outputting the increased and reduced driving force, a rotating shaft 16 connected to the output shaft 15, an ice tray 17 rotatably mounted on the rotating shaft 16, a supporting frame 18 for supporting the ice tray 17, and a sensing means(not shown) for sensing the rotating condition of the output shaft 15. Further, the ice maker 10 is provided with a full ice condition sensing lever 30 for sensing whether or not (restore) bin 40 is filled with ice cubes. The water supplying device 20 is capable of repeatedly delivering a predetermined amount of water, e.g., 105+15 cc to the ice tray 17 via a supply conduit 22 as shown in FIG. 1.

When the water supplied to the ice tray 17 as shown in FIG. 3A is frozen to form ice cubes, the ice tray 17 is overturned until a projection 19 of the ice tray 17 is in contact with a hooking portion 18*a* of the supporting frame 18 as shown in FIG. 3B. Thereafter, the ice tray 17 is twisted to eject the ice cubes therefrom, depositing them on the (restore) bin 40. The ice tray 17 is then overturned again to receive the water. These operations are repeatedly performed until a predetermined amount of the ice cubes is collected in the (restore) bin 40.

When the (restore) bin 40 becomes fully packed with ice cubes, the ice making apparatus described above must be able to sense a reverse condition of the ice tray 17 to thereby control the eject operation of the ice tray 17. In order to sense such a reverse condition, the ice maker 10 is further provided with a reverse condition sensing mechanism as shown in FIG. 4.

The reverse condition sensing mechanism, as shown, includes a reverse condition sensing shaft cam 52 having two concave portions 54 and 56 and a convex portion 58 therebetween and formed around the output shaft 16 and a reverse condition sensing switch 62, such as a microswitch, having a contact terminal 64. In FIG. 4A, there is shown an ice making condition of an ice maker 10, in which the contact terminal 64 of the sensing switch 62 is inserted into the concave portion 54 in such a way that the sensing switch 62 is at OFF position. At the beginning of an ice removing operation, the motor 12 energizes and the output shaft 16 into which the rotating force of the motor 12 is delivered through the gear mechanism 14 is rotated in a direction of the arrow as shown in FIG. 4A, thereby releasing the contact terminal 64 of the sensing switch 62 from the concave portion 54. As a result, the contact terminal 64 is pressed by the convex portion 58 in such a way that the sensing switch 62 is at ON position.

Referring to FIG. 4B, after the ice tray 17 is rotated approximates 1220 times, the contact terminal 64 of the sensing switch 62 is inserted into the concave portion 56 in such a way that the sensing switch 62 is at OFF position, resulting a controller (not shown) sensing the reverse condition of the ice tray 17. After a predetermined time have lapsed, the motor 12 is reversed by the controller so as to allow the ice tray 17 to return the original position. At this time, the output shaft 15 and the reverse condition sensing switch 62 are also returned to the position as shown in FIG. 4A.

However, in such a conventional reverse condition sensing mechanism, it is extremely difficult to perform a precise ON/OFF switching since the shaft cam cannot precisely machine, thereby entailing a malfunction of contacts.

SUMMARY OF THE INVENTION

It is, therefore, a primary object of the present invention to provide an ice making apparatus for use in a refrigerator incorporating therein a reverse condition sensing mechanism capable of carrying out an overturning operation of an ice tray reliably and having a reduced number of parts or components.

The above and other objects of the invention are accomplished by providing an ice making apparatus for use in a refrigerator incorporating therein a reverse condition sensing mechanism, the reverse condition sensing mechanism comprising:

a movable lever mounted on an output shaft of a motor to be rotated therewith and having a shaft fixing portion fixed into the output shaft for rotating an ice tray, a rotating portion extending from the shaft fixing portion and vertically projected therefrom, and a contacting conductor mounted on a surface of the rotating portion; and a fixing plate vertically mounted on a periphery surface of the output shaft and having a horizontal contact for sensing a horizontal condition of the ice tray and a reverse contact for sensing a reverse condition of the ice tray, the contacts being at intervals of a predetermined distance.

BRIEF DESCRIPTION OF THE DRAWINGS

The above and other objects and features of the present invention will become apparent from the following description of preferred embodiments given in conjunction with the accompanying drawings, in which.

DETAILED DESCRIPTION OF THE PREFERRED EMBODIMENTS

Figure 1:
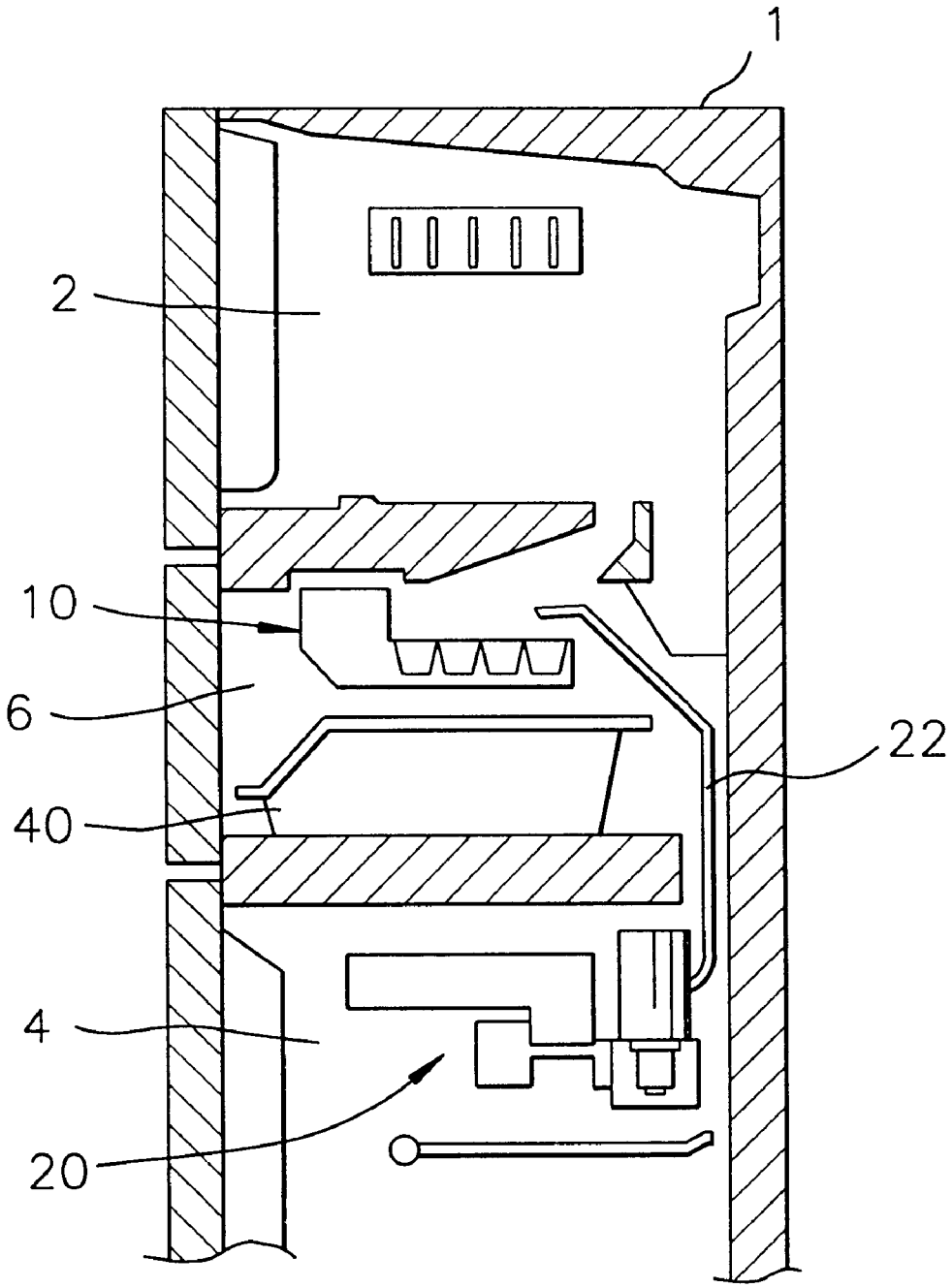
FIG. 1 (PRIOR ART)
FIG. 1 shows a cross sectional view for showing an internal structure of a prior art automatic ice making apparatus in a refrigerator.
Figure 2:
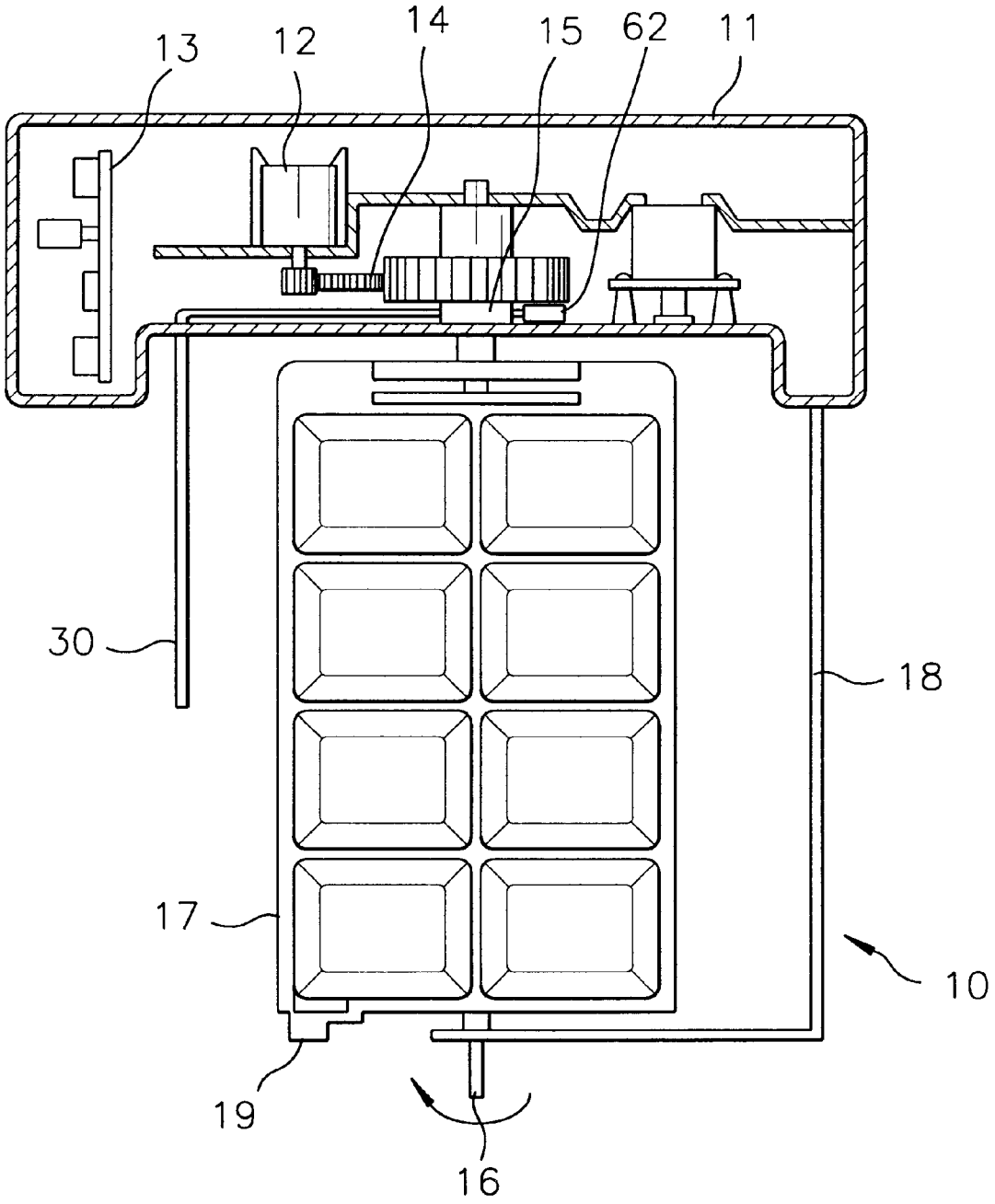
FIG. 2 (PRIOR ART)
FIG. 2 represents a schematic top plan view of an ice maker of the automatic ice making apparatus in FIG. 1.
Figure 3A:
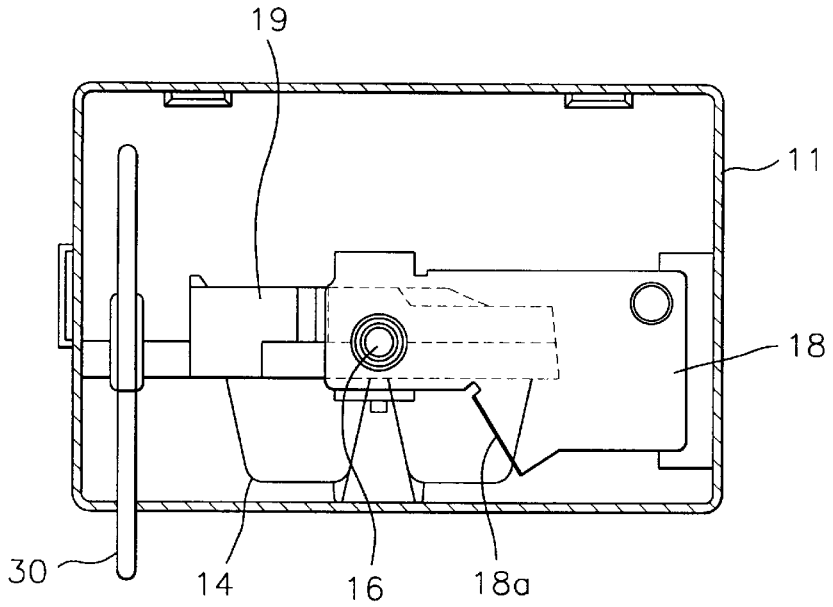
FIG. 3A (PRIOR ART)
FIGS. 3A and 3B are rear views of an ice tray in FIG. 2 illustrating the ice making operation and the ice removing operation thereof.
Figure 3B:
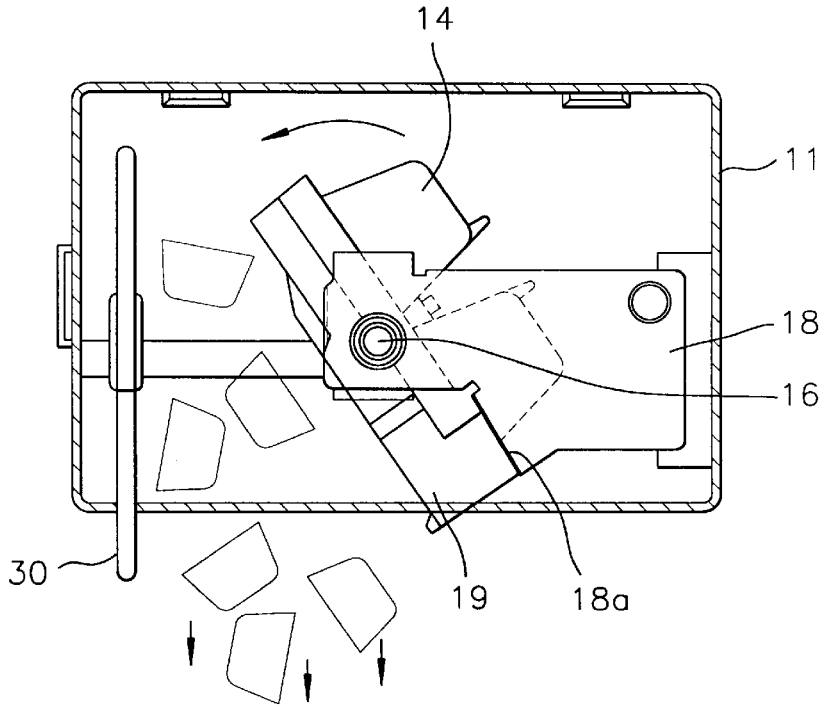
FIG. 3B (PRIOR ART)
Figure 4A:
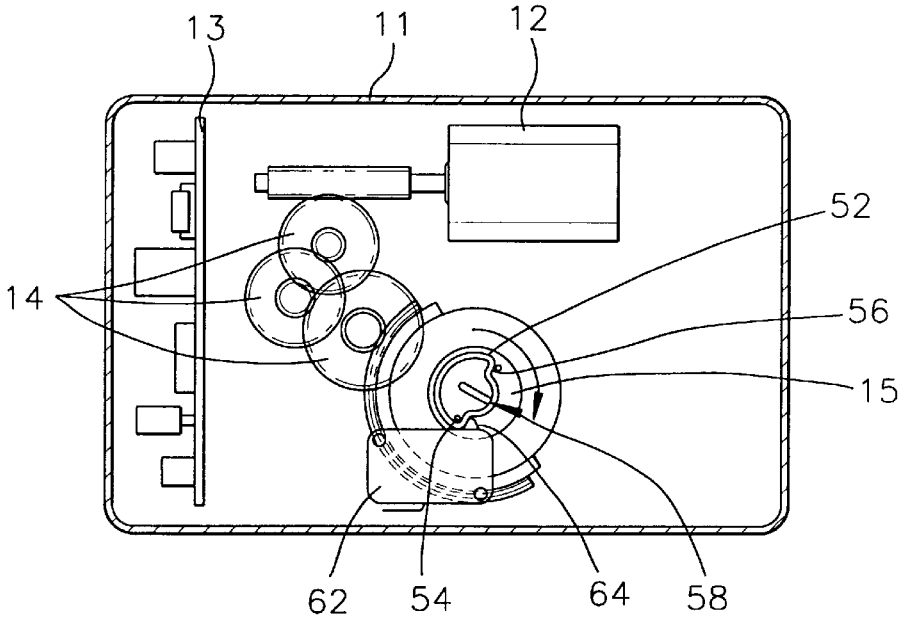
FIG. 4A (PRIOR ART)
FIGS. 4A and 4B depict front views illustrating a reverse condition sensing mechanism prior to and posterior to an ice removing operation of the ice making apparatus previously disclosed.
Figure 4B:
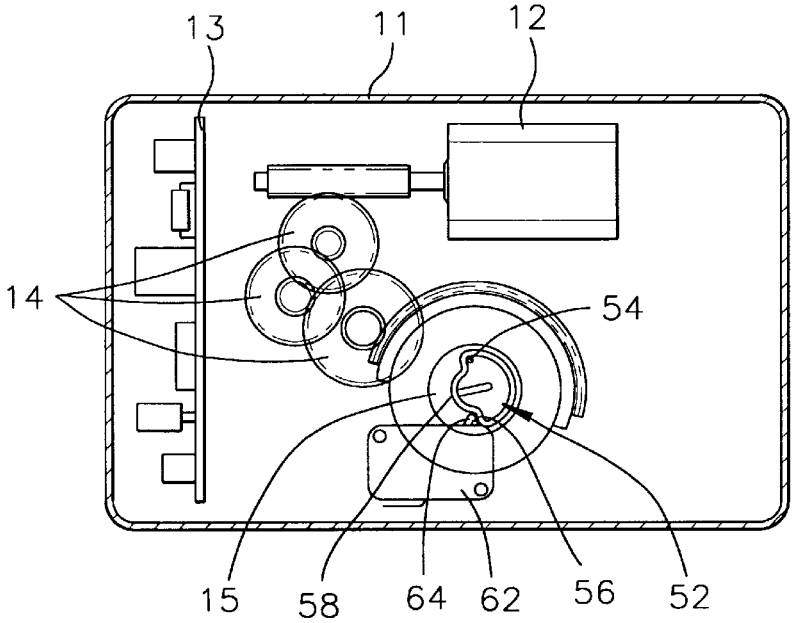
FIG. 4B (PRIOR ART)
Figure 5:
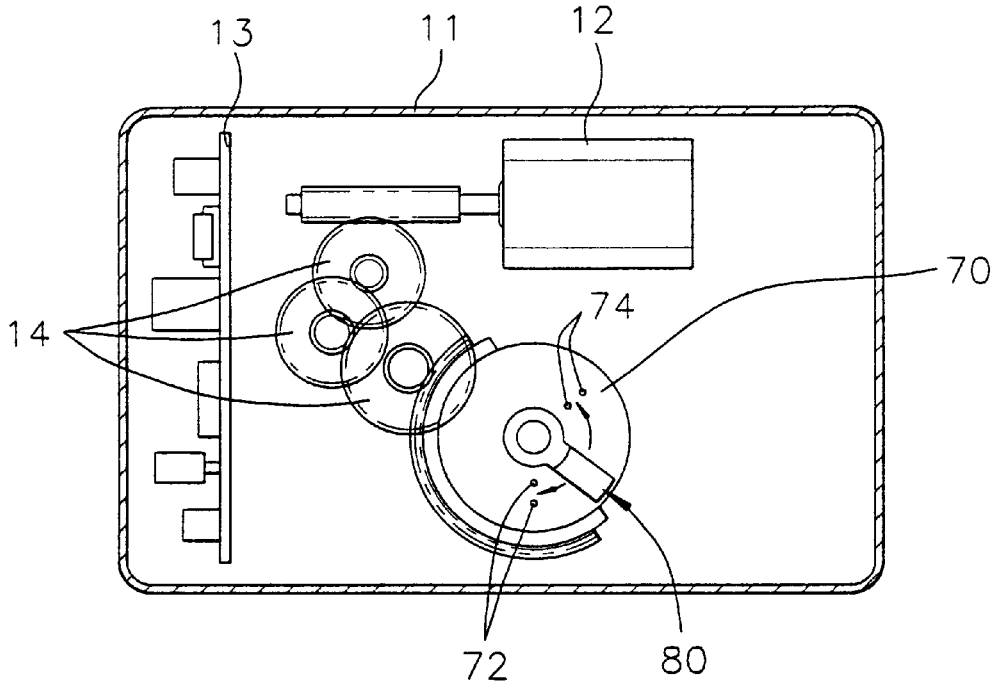
FIG. 5 demonstrates a front view illustrating a reverse condition sensing mechanism in accordance with the present invention.
Figure 8:
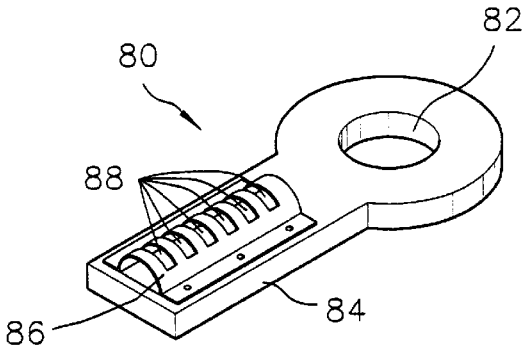
FIG. 8 explains a perspective view of a movable lever in accordance with the present invention.
Figure 9:
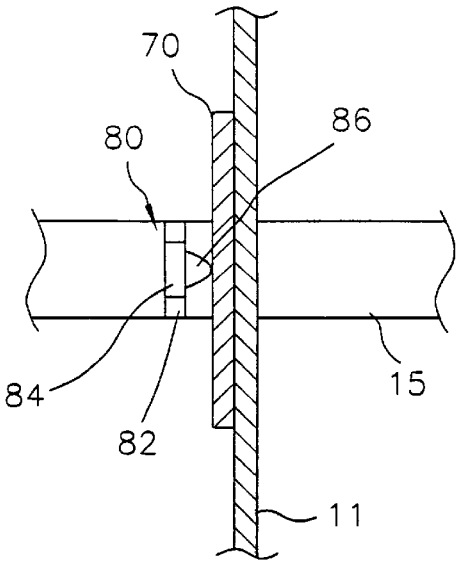
FIG. 9 provides a partial sectional view for showing the structure of a reverse condition sensing mechanism in accordance with the present invention.

Referring to FIGS. 5 and 9, there is shown a reverse condition sensing mechanism in accordance with a preferred embodiment of the present invention. As shown, the inventive reverse condition sensing mechanism includes a movable lever 80 mounted on an output shaft 15 of a motor 12 to be rotated therewith and a fixing plate 70 vertically mounted on a periphery surface of the output shaft 15. The movable lever 80, as best shown in FIG. 8, is provided with a ring-shaped shaft fixing portion 82 fixed into the output shaft 15 for rotating an ice tray, a rotating portion 84 extending from the shaft fixing portion 82 and vertically projected therefrom, and a contacting conductor 86 mounted on a surface of the rotating portion 84. The contacting conductor 86 of the movable lever 80 is made of a conductive thin film of, e.g., copper, convexly formed at a center portion of the rotating portion 84. In order to elastically bend the center portion of the contacting conductor 86, it is preferred that the contacting conductor 86 may be further provided with a plurality of slits 88 in parallel.

Figure 6:
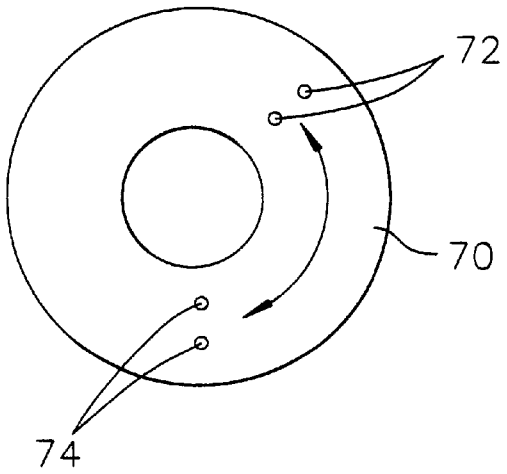
FIGS. 6 and 7 set forth perspective views for showing a 10 fixing plate in accordance with the present invention.

In FIG. 6, the fixing plate 70, made of electrically insulated materials, is provided with a horizontal contact 72 for sensing a horizontal condition of the ice tray and a reverse contact 74 for sensing a reverse condition of the ice tray, the contacts 72 and 74, made of a pair of conductive materials, being at intervals of a predetermined distance. The horizontal contact 72 and the reverse contact 74 are electrically contacted with the contacting conductor 86 of the movable lever 80. Accordingly, when the ice tray connected to the output shaft 15 is in a horizontal condition, the horizontal contact 72 is electrically contacted with the conductor 86, whereas when the ice removing operation is performed, the horizontal contact 72 is short-circuited. Then, when the ice tray is in a reverse condition, the reverse contact 74 is electrically contacted with the contacting conductor 86.

Figure 7:
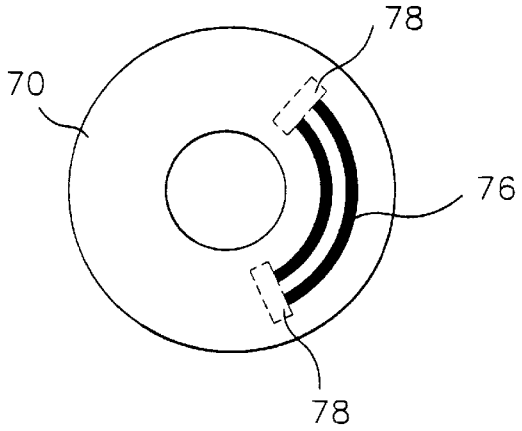

On the contrary, as shown in FIG. 7, it is preferred that the fixing plate 70, made of conductive materials, may be provided with two circle arches 76 having a different diameter and the horizontal and the reverse contacts 78, made of electrically insulated materials, mounted adjacent to both ends of the circle arches 76, respectively. Accordingly, when the ice tray connected to the output shaft 15 is in a horizontal condition, the horizontal contact 78 is contacted with the conductor 86, thereby being electrically short-circuited, whereas when the ice removing operation is performed, two circle arches 78 are electrically contacted with the conductor 86. Further, when the ice tray is in a reverse condition, the reverse contact 78 is contacted with the conductor 86, thereby being electrically short-circuited.

As descried above, the ice removing operation and the returning operation of the inventive reverse condition sensing mechanism are same as described in FIGS. 1 to 4 to be omitted.

While the present invention has been described with respect to the preferred embodiment, it will be understood by those skilled in the art that certain changes and modifications may be made without departing from the scope of the invention as defined in the following claims.

What is claimed is:

1. An ice making apparatus for use in a refrigerator incorporating therein a reverse condition sensing mechanism, the reverse condition sensing mechanism comprising:

a movable lever mounted on an output shaft of a motor to be rotated therewith and having a shaft fixing portion fixed into the output shaft for rotating an ice tray, a rotating portion extending from the shaft fixing portion and vertically projected therefrom, and a contacting conductor mounted on a surface of the rotating portion; and a fixing plate vertically mounted on a periphery surface of the output shaft and having a horizontal contact for sensing a horizontal condition of the ice tray and a reverse contact for sensing a reverse condition of the ice tray, the contacts being at intervals of a predetermined distance.

2. The apparatus as recited in claim 1, wherein the contacting conductor of the movable lever is made of a conductive thin film convexly formed at a center portion of the rotating portion.

3. The apparatus as recited in claim 2, wherein the contacting conductor is provided with a plurality of slits in parallel in order to allow the center portion thereof to be elastically bent.

4. The apparatus as recited in claim 1, wherein the fixing plate is made of electrically insulated materials and the horizontal and the reverse contacts are made of conductive materials, respectively, the horizontal and the reverse conditions being sensed depending on the contacts being electrically contacted with the contacting conductor of the movable lever.

5. The apparatus as recited in claim 1, wherein the fixing plate is made of conductive materials and is provided with two circle arches having a different diameter and the horizontal and the reverse contacts, made of electrically insulated materials, mounted adjacent to both ends of the circle arches, respectively, the horizontal and the reverse conditions being sensed depending on the contacting conductor of the movable lever being contacted without the contacts.

* * * * *